United States Patent [19]

Humphries

[11] 4,236,655

[45] Dec. 2, 1980

[54] CONTAINER WITH FLEXIBLE NOZZLE

[75] Inventor: Romilly H. Humphries, Dover, Mass.

[73] Assignee: S.A.Y. Industries, Inc., Leominster, Mass.

[21] Appl. No.: 939,855

[22] Filed: Sep. 5, 1978

[51] Int. Cl.[3] ..... B65D 23/10; B65D 25/46

[52] U.S. Cl. ..... 222/465; 222/530

[58] Field of Search ..... 222/107, 465, 475, 527–530, 222/538, 566, 572; 220/85 SP

[56] References Cited

U.S. PATENT DOCUMENTS

| | | | |
|---|---|---|---|
| 1,913,895 | 6/1933 | Paull | 222/530 X |
| 2,260,008 | 10/1941 | Deshayes | 222/107 |
| 2,789,728 | 4/1957 | Britton | 222/107 |
| 2,957,614 | 10/1960 | Krajcovic | 222/530 X |
| 2,987,228 | 6/1961 | Matson | 222/530 X |
| 3,181,743 | 5/1965 | Libit et al. | 222/530 X |
| 3,250,434 | 5/1966 | Howlett | 222/465 X |
| 3,392,887 | 7/1968 | Bross | 222/530 X |
| 3,476,111 | 11/1969 | Matheson | 222/530 X |
| 3,690,522 | 9/1972 | Chlystun | 222/529 |

*Primary Examiner*—F. J. Bartuska

*Attorney, Agent, or Firm*—Wolf, Greenfield & Sacks

[57] ABSTRACT

A container for storing and dispensing fluids, especially automotive fluids, comprising a single-piece, integrally formed, thin-walled member defining a hollow body having a continuous sidewall and opposite end walls, an elongated tubular nozzle integral with and extending from one of said end walls, a handle in said sidewall comprising an elongated fold in said sidewall providing a pair of facing segments of said sidewall and aligned elongated holes in said segments with the edges of said holes integrally connected. The nozzle has a flexible segment and can be flexed to and from a position adjacent to one end wall, where interlocking clamp or clamps formed on facing surfaces of the nozzle and end wall serve to lock the nozzle in a flexed position. The end of the nozzle is threaded to receive a conventional screw-on cap.

5 Claims, 4 Drawing Figures

CONTAINER WITH FLEXIBLE NOZZLE

FIELD OF THE INVENTION

The present invention relates generally to storage containers for fluids, and more particularly to disposable containers used for dispensing fluids such as anti-freeze, gasoline, lubricating oil or windshield wiper detergent into hard-to-reach receptacles inside automobiles. Such dispensing containers are conventionally provided with, or adapted to be connected to, long pouring spouts or nozzles, which must extend for use yet secure for storage in a space-conserving manner.

DESCRIPTION OF THE PRIOR ART

The conventional gasoline can comprises a fabricated metal box with a handle and screw closure on top. A separate metal spout has an annular ring around its base so that it can be mounted either protruding from the top of the can for use or extending down into the can for storage. This storage procedure results in getting the fluid product all over the outside of the spout, which is unsuitably messy for products of high surface tension, such as motor oil. Since the spout must withstand prolonged immersion in the product, it is typically of a rigid metal, so that the aiming of the spout at the target receptacle and the pouring operation must be accomplished simultaneously, with attendant spillage penalties for error. This operation is not made any easier by the fact that the location of the handle, while fine for carrying the can, is too far from the center of gravity of a tilted or horizontal can to be of any help, so that user must get a grip on the sides of the can instead.

The conventional motor oil can is not provided with a spout at all, requiring the user to find a combination piercer and spout, which conventionally suffers from the same rigidity described above.

One solution to the aforementioned problems is to provide a flexible spout which can be left permanently attached to the outside of the container, yet folded alongside for compact storage. In fact, a number of such devices have been patented for containers for various kinds of fluids, and are described in U.S. Pat. Nos. 1,913,895; 2,957,614; 2,987,228; 3,181,743; 3,392,887; and 3,476,111. However, most of these disclosures involve complicated and expensive methods of fabricating the container and spout together and equally cumbersome ways of attaching the fasteners for holding the spout in the folded position, usually involving piercing of the container wall, with all the leakage possibilities which that presents.

Accordingly, it is a primary object of the present invention to provide a container for fluids which is integrally formed with a flexible spout or nozzle.

It is a further object of this invention to provide such a container with nozzle locking means integral with the container.

It is yet another object of this invention to provide a dispensing container with an integrally formed handle adjacent the center of gravity of a container in its dispensing orientation.

It is still another object of this invention to provide a container, spout and handle which can be blow-molded as a single piece of plastic.

FEATURES OF THE INVENTION

To accomplish these and other objects, the container of this invention provides an elongated tubular nozzle with annular pleats or corrugations near its base for flexibility that extends from the top of the container. The nozzle has screw threads at its tip to receive a conventional screw-on cap and a clamp or row of clamps along the surface to be folded against the container.

The preferred embodiment of the invention also provides a continuous sidewall merging into opposing top and bottom end walls, the top wall having a clamp or row of clamps integral with its outer surface, matching and interengaging the clamp or clamps on the folding nozzle.

A third feature of the preferred embodiment comprises a handhold, formed by aligned holes in a pair of facing segments of the sidewall and a tubular handle connected at each of its ends to the sidewall.

Yet another feature is the stepped configuration of the top end wall, whereby the portion of the end wall to which the nozzle is clamped is further from the opposing bottom end wall than the portion from which the nozzle extends, reducing the sharpness of the bend in the nozzle required to clamp it to the end wall.

BRIEF FIGURE DESCRIPTION

Other objects, features and advantages will appear from the following description of a preferred embodiment of the invention as shown in the accompanying drawings, in which.

DETAILED DESCRIPTION OF THE DRAWINGS

Figure 1:
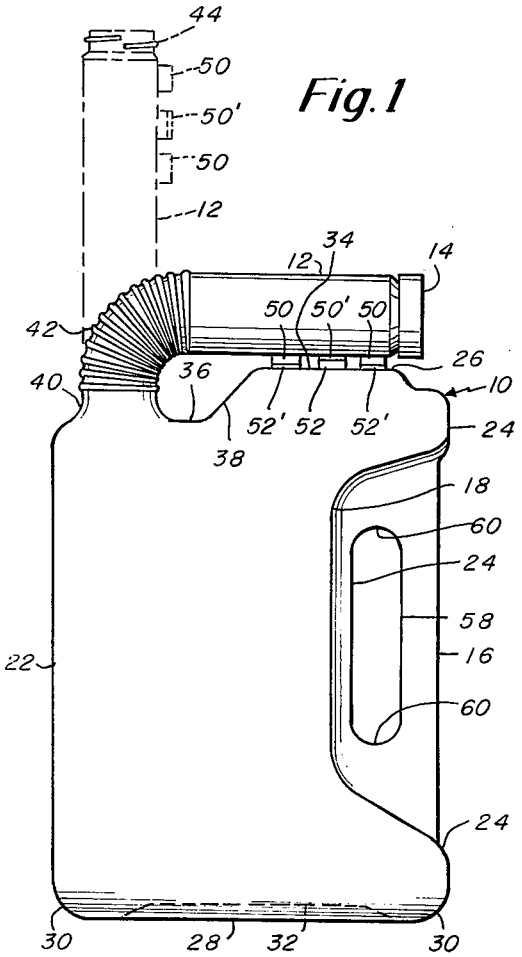
FIG. 1 is a reduced front view of a container illustrating a preferred embodiment of the invention and showing the uncapped and extended nozzle in broken lines and the nozzle capped and clamped down for storage in solid lines.
Figure 2:
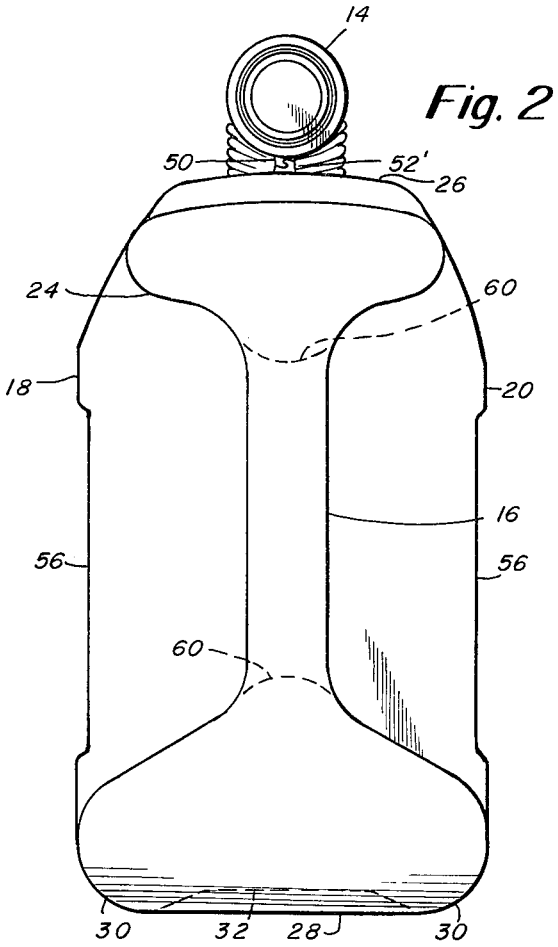
FIG. 2 is a side view of the container, showing the handle and the manner in which the sidewall tapers in to form the handhold behind the handle.

There is shown in FIG. 1 a container 10 having a flexible nozzle 12, a screw-on cap 14, and a tubular handle 16. The container 10 is basically a rectangular box with rounded corners and edges, comprising continuous sidewalls with a front side 18, a back side 20, a left side 22, a right side 24 tapering into handle 16, and top and bottom end walls 26 and 28, as shown in FIGS. 1 and 2. Bottom wall 28 comprises a rectangular rim 30 surrounding a shallow recess 32. Top wall 26 comprises a flat upper portion 34 adjacent right side 24, a flat lower portion 36 adjacent left side 22, and a sloping portion 38 connecting the other two.

Extending vertically from lower portion 36 of top wall 26 is tapered frusto-conic like base 40 of nozzle 12. Immediately above and adjoining base 40 is corrugated section 42 formed by annular pleats or folds in nozzle 12. Section 42 preferably extends from a level below the plane of upper portion 34 of top wall 26 along at least one third of the length of nozzle 12, and sufficient to permit the nozzle to be bent at an angle of 90° in section 42. The portion of the nozzle between section 42 and its free end is rigid and terminates in a circular opening surrounded by screw threads 44 for engaging cap 14, as shown in FIG. 1.

Figure 3:
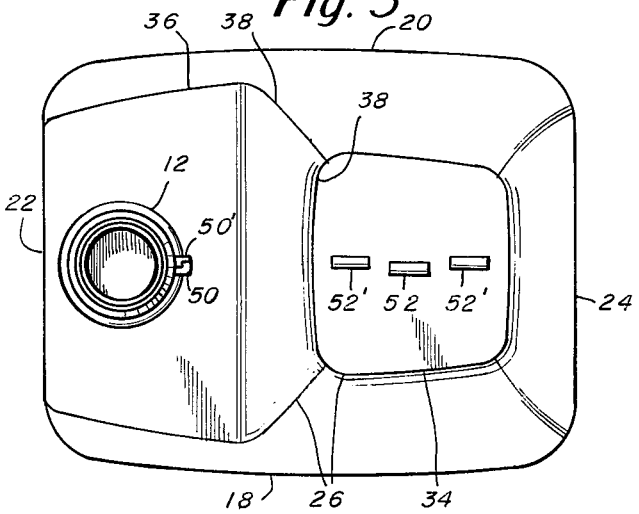
FIG. 3 is a top view of the container with the nozzle in the unflexed position, and showing the location of the clamp or clamps integral with the top wall of the container.
Figure 4:
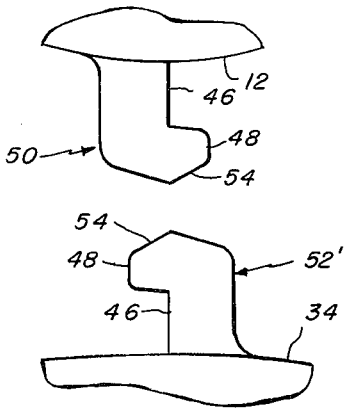
FIG. 4 is a fragmentary, enlarged, view of two interlockable clamps.

Several hook-like clamps 50 are formed on the outer surface of nozzle 12 between corrugated section 42 and screw threads 44. These clamps are arranged in a row parallel to the axis of nozzle 12, along the line of tangency between the cylindrical surface of nozzle 12 and the flat surface of wall 34 when the nozzle is bent. Each clamp is hook-like in configuration and comprises a rectangular post 46, topped by a tooth 48, laterally projecting toward either front 18 or back 20 of the container, as shown in FIG. 4. Preferably, there are two rearwardly facing clamps 50, separated by one forwardly facing clamp 50', as shown in FIG. 1. These engage two forwardly facing clamps 52' and one rearwardly facing clamp 52 arranged in a matching row along upper portion 34 of top wall 26, equidistant from front 18 and back 20, as shown in FIG. 3. Thus, the nozzle clamps each engage oppositely facing top wall clamps to form locking pairs 50–52', 50'–52, and 50–52', as shown in FIG. 1. The fact that the directions in which the clamps on each surface alternate reduces the possibility of accidental disengagement of the clamp pairs and consequent release of the nozzle 12. A diagonal surface 54 on top of each tooth 48 renders engagement possible by mere pushing of the clamps together, as shown in FIG. 4.

The spacing between the clamps is such that the clamp pairs may be disengaged when desired by extending the bent nozzle 12 along its axis until the overlap between clamps is reduced or eliminated, then pulling the clamps apart by lifting the nozzle. The pleats in corrugated section 42 facilitate this procedure by their telescoping action. These pleats in section 42 thus have a dual function of allowing the nozzle 12 to be bent to a folded position as illustrated in FIG. 1 and also permit longitudinal extension of the nozzle to permit it to be disengaged from the clamps.

Front and back sidewalls 18 and 20 each have a recessed planar label panel 56 beginning about 1/5 of the height of the container above the bottom wall 28, extending upward a distance approximating half the height of the container and covering the entire width of sides 18 and 20. This feature prevents the labels of containers packed adjacent to one another from adhering and reduces the likelihood of dirt or grease obscuring the manufacturer's label.

Sides 18 and 20 do not form linear edges with side 24 but rather taper toward one another, into a fold in which a handhold or slot 58 of oval cross-section is in turn formed. The sides 18 and 20 and vertical tubular handle 16 are best shown in FIG. 1. As viewed from the front or back of the container, the slot 58 comprises elongated holes in each of the folds which extend from segments 18 and 20, with the holes aligned and integrally connected. The upper and lower surfaces 60 of slot 58 are what are known topologically as saddles, being concave in one cross-section, as shown looking from side 18 in FIG. 1, and convex in an orthogonal cross-section, as shown in phantom looking at side 24 in FIG. 2.

The part of right side 24 lying in a vertical plane thus resembles an hourglass or dogbone, with the outer surface of tubular handle 16 forming the elongated central portion. The remaining parts of right side 24 are not planar, but taper inward from the upper and lower planar parts, intersecting with sides 18 and 20 along a curve resembling a bowl on its side, as shown in FIG. 1. These same parts also taper from the side of slot 58 toward left side 22 until they join label panels 56.

Bottom end wall 28 is rectangular with a rounded rim 30 and with a central recess or dimple 32. The weight of the container is normally borne by the rim 30, while dimple 32 minimizes adhesion to sticky surfaces.

Except for cap 14, the entire container and nozzle may be blow-molded from plastic in a single operation. Suitable plastics include polyethylene, polypropylene, and others if similar density and fatigue resistance.

The container is molded with the nozzle 12 in a free-standing upright position, as shown in phantom in FIG. 1, so that the container can be filled in the conventional vertical orientation. After filling, the cap 14 is screwed on and the nozzle 12 is bent 90° and clamped to top wall 26 for shipment and storage. The container can be used to package and store anti-freeze, gasoline, lubricating oil, windshield wiper detergent or any of a number of other fluids.

The flexibility of the nozzle 12 allows it to be positioned over the crankcase, radiator or other orifice before the rest of the container is tilted to start the contents flowing. The length of the nozzle allows additional "travel time" to correct the positioning of the nozzle before the fluid comes out, thereby further reducing the likelihood of spillage. The diameter of the nozzle may be varied according to the viscosity of the product, the desired flow rate, and the size of the aperture into which the product will be poured.

The location of the handle 16 near the center of gravity of a horizontally oriented container allows much easier handling and greater control over the pouring operation.

Having now described my invention, what I claim is:

1. A container for fluids comprising:

a single piece, integrally formed, thin-walled, self-supporting member defining a non-collapsible rigid hollow body of fixed shape having rigid continuous substantially flat side walls and self-supporting opposite top and bottom end walls, the bottom end wall being a rigid substantially flat surface, an elongated tubular nozzle integral with and extending from the top end wall, said nozzle adapted to be moved between storage and pouring positions, said nozzle having a flexible segment and said nozzle adapted to remain in a substantially rigid position extending outwardly from the container when in a pouring position and adapted to be flexed to other pouring positions under the influence of an external force, said top end wall having the shape of a stepped configuration such that when the nozzle is in its storage position the portion of the top end wall over which the free end of the nozzle extends in a storage position is further from the opposing bottom end wall than the portion from which the nozzle extends, so that the sharpness of the bend in the nozzle required to store it over the end wall is reduced and so that the major portion of the nozzle is substantially parallel to the bottom end wall when the nozzle is in said storage position, means for securing the nozzle in the storage position adjacent the top end wall and means forming a handle in said sidewalls.

2. A container as set forth in claim 1 wherein said handle is formed of an elongated fold in one sidewall providing a pair of facing segments of said sidewall and aligned elongated slots in said segments with the edges of said slots integrally connected.

3. A container as set forth in claim 1 wherein said means for securing said nozzle comprises interlockable means integrally formed in part on said nozzle and in part on said one end wall.

4. A container as set forth in claim 2, wherein said handle is located adjacent the center of gravity of the container when the container is tilted so as to orient said end walls vertically, and wherein said handle is shorter than the height of said one sidewall and with said slots intermediate said end walls.

5. A container as set forth in claim 1 wherein said flexible segment is adjacent said one end wall.

* * * * *